US007384307B1

(12) United States Patent
Wang

(10) Patent No.: US 7,384,307 B1
(45) Date of Patent: Jun. 10, 2008

(54) COAXIAL CABLE END CONNECTOR

(75) Inventor: Chao-Pin Wang, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 11/890,486

(22) Filed: Aug. 7, 2007

(51) Int. Cl.
*H01R 9/05* (2006.01)

(52) U.S. Cl. ..... 439/578; 439/460; 439/585; 439/394

(58) Field of Classification Search ..... 439/578, 439/583, 585, 394, 460
See application file for complete search history.

(56) References Cited

U.S. PATENT DOCUMENTS 4,386,817 A * 6/1983 Benker et al. ..... 439/460
4,469,391 A * 9/1984 Rich ..... 439/404
4,701,001 A * 10/1987 Verhoeven ..... 439/394
4,799,900 A * 1/1989 Capp et al. ..... 439/585
5,044,978 A * 9/1991 Gelin ..... 439/394
5,120,259 A * 6/1992 Nakata et al. ..... 439/585
6,425,776 B1 * 7/2002 Fredl ..... 439/320
6,660,935 B2 * 12/2003 Southard et al. ..... 362/640
6,837,743 B2 * 1/2005 Ko ..... 439/582
7,008,256 B2 * 3/2006 Poiraud ..... 439/394
7,273,394 B1 * 9/2007 English ..... 439/582
2002/0030329 A1 * 3/2002 Montena ..... 280/1
2002/0194728 A1 * 12/2002 Hathaway et al. ..... 29/828

* cited by examiner

*Primary Examiner*—Neil Abrams
*Assistant Examiner*—Harshad C Patel
(74) *Attorney, Agent, or Firm*—Rosenberg, Klein & Lee

(57) ABSTRACT

A coaxial cable end connector includes two hollow and coaxial inner and outer sleeves. The outer sleeve is provided with at least one transverse slot for receiving a clamping structure therein. The clamping structure is formed at a bottom surface with a plurality of teeth. When a coaxial cable is inserted into the end connector, the jacket and the braided conducting sheath of the cable are located in an annular space between the inner and the outer sleeve. By forcing the clamping structure toward a center of the outer sleeve, the teeth at the bottom surface of the clamping structure are brought to tightly press against and connect to the jacket of the coaxial cable.

5 Claims, 3 Drawing Sheets

COAXIAL CABLE END CONNECTOR

FIELD OF THE INVENTION

The present invention relates to a coaxial cable end connector for connecting a coaxial cable to a specified device, such as a dedicated receiver or terminal on a cabled TV; and more particularly to a coaxial cable end connector that is connected to a coaxial cable via a clamping structure.

BACKGROUND OF THE INVENTION

A coaxial cable connector is a widely known device. Many coaxial cable connector types are available in the market. Among others, a type F connector is typically screwed to a complementary interface connector for electrically connecting a coaxial cable to different types of electronic devices, such as TV sets, CB (citizens' band) radios, FM (frequency modulation) radios, and other amateur radio systems.

A conventional coaxial cable connector includes a main body having a ring member, a cylindrical member coaxially arranged in the ring member, and a nut fitted around the cylindrical member.

The coaxial cable connector is connected to a coaxial cable by pushing an end of the coaxial cable into the main body of the coaxial cable connector, such that an insulator and a central conductor of the coaxial cable are located in the cylindrical member, and a braided conducting sheath and a jacket of the coaxial cable are located between the ring member and the cylindrical member. A hexagonal crimping tool is then used to compress the ring member of the connector against the jacket of coaxial cable to firmly join them together. Due to various sizes of the coaxial cable, at least three hexagonal crimping tools of different sizes are needed to ensure that a sufficient compression force has been applied to the ring member of the coaxial cable connector. Therefore, additional costs and tools are needed to complete the connection of the conventional coaxial cable connector to the coaxial cable, and it is inconvenient for an operator to carry a lot of tools for the purpose of connecting the connector to the coaxial cable.

It is therefore desirable to develop an end connector that can be tightly connected to a coaxial cable without the need of multiple dedicated crimping tools.

SUMMARY OF THE INVENTION

A primary object of the present invention is to provide a coaxial cable end connector that is connected to a coaxial cable via a clamping structure. The clamping structure includes at least one sliding member mounted in a transverse slot provided on an outer sleeve of the end connector and having a plurality of teeth provided on a bottom surface thereof, such that the sliding member can be forced toward a center of the outer sleeve to tightly press the teeth against the jacket of a coaxial cable inserted into the end connector, causing the end connector to effectively and tightly connected to an end of the coaxial cable.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
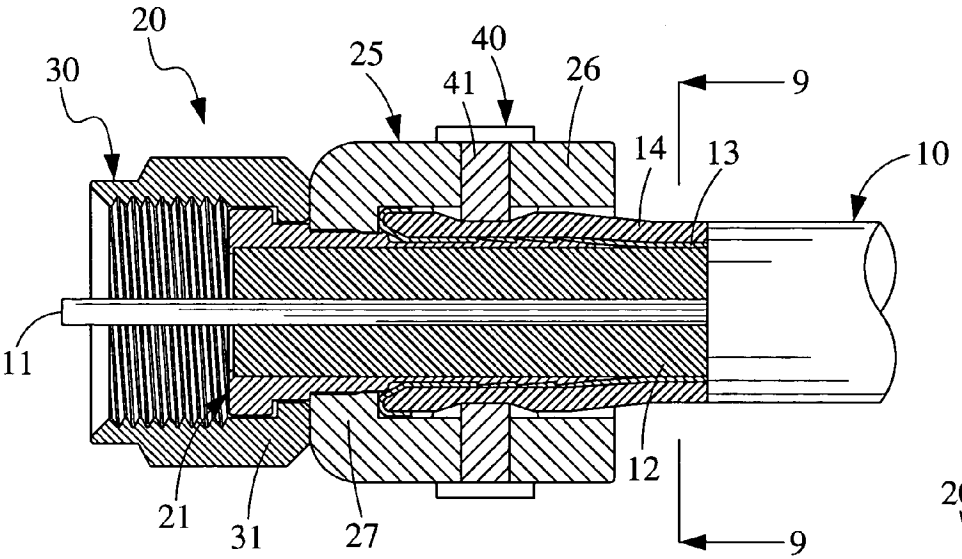
FIG. 1 is a longitudinal sectional view of a coaxial cable end connector according to the present invention with a coaxial cable connected thereto.

Please refer to FIG. 1. A conventional coaxial cable 10 consists of a central conductor 11, an insulator 12 surrounding the central conductor 11, at least one layer of braided conducting sheath 13 surrounding the insulator 12, and a jacket 14 surrounding the braided conducting sheath 13. To ensure effective connection of the coaxial cable 10 to a receiver and terminal, for example, a front end of the coaxial cable 10 must be stripped by a predetermined distance, and the exposed braided conducting sheath 13 thereat must be separated from the insulator 12 and then turned backward to overlap the jacket 14, so as to expose the central conductor 11 and the insulator 12 at the front end of the coaxial cable 10.

Figure 2:
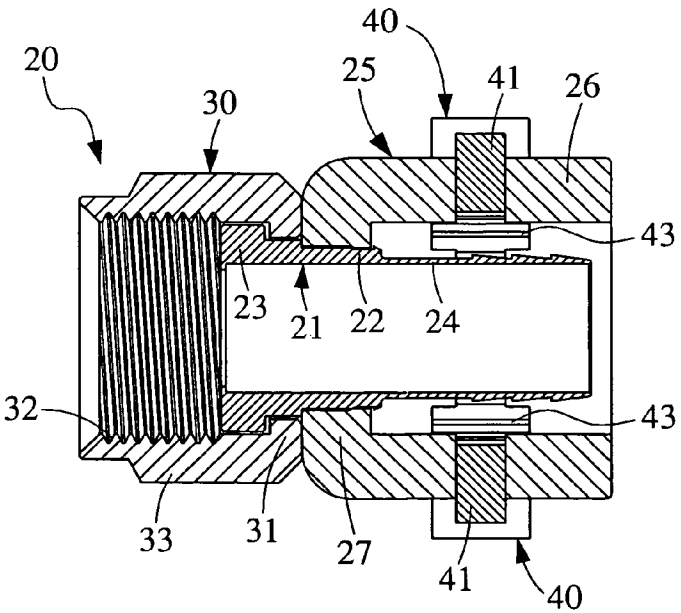
FIG. 2 is a longitudinal sectional view of the coaxial cable end connector of FIG. 1 with the coaxial cable removed therefrom.

As can be seen from FIGS. 1 and 2, a coaxial cable end connector 20 according to the present invention includes an inner sleeve 21 and an outer sleeve 25.

The inner sleeve 21 has a front portion formed into a radially outward extended flange 23, a rear portion formed into an extension section 24, and a middle portion located between the front and the rear portion 23, 24 to constitute a main body 22 of the inner sleeve 21. It is noted the extension section 24 has an outer diameter and wall thickness smaller than those of the main body 22. The outer sleeve 25 includes a main body 26, a front end of which is formed into a radially inward extended flange 27.

The inner sleeve 21 is partially received in the outer sleeve 25, such that the inward flange 27 of the outer sleeve 25 is fitted around the main body 22 of the inner sleeve 21, and the extension section 24 of the inner sleeve 21 is located in the main body 26 of the outer sleeve 25 to be concentric with the main body 26. In this manner, an annular space is defined between the extension section 24 and the main body 26.

Figure 3:
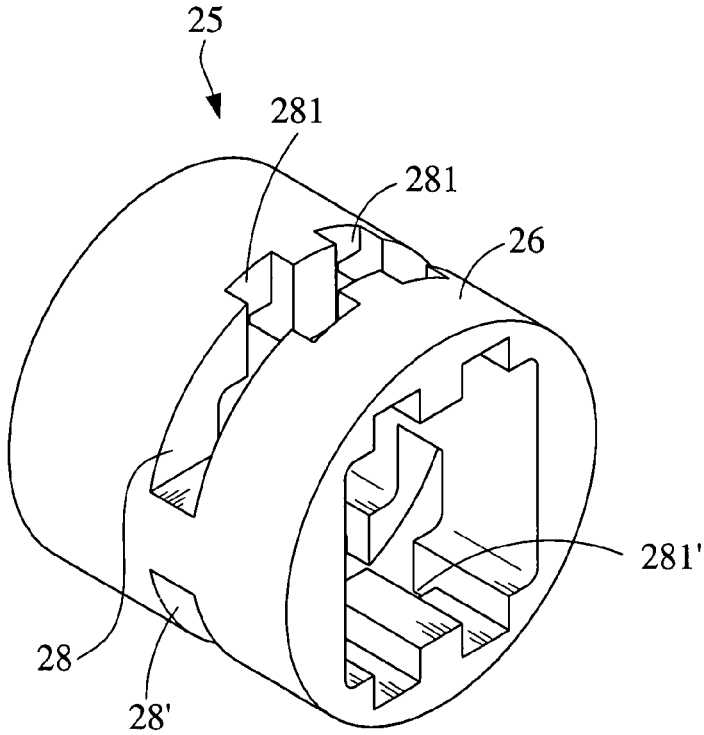
FIG. 3 is a perspective view of an outer sleeve included in the end connector of the present invention.

Please also refer to FIG. 3, which is a perspective view of the outer sleeve 25. As shown, the main body 26 of the outer sleeve 25 is externally provided at a predetermined position with two spaced, diametrically opposite, and transversely extended identical slots 28, 28'. Each of the transverse slots 28, 28' is provided with at least one longitudinally extended guide slot 281, 281'. In the illustrated embodiment, there are two guide slots 281, 281' provided on each of the slots 28, 28'.

The end connector 20 may be configured into different connection interfaces, including F connector, BNC connector, RCA connector, and IEC connector. In the following description of the present invention, the end connector 20 is configured as an F connector simply for the purpose of exemplification.

As shown in FIGS. 1 and 2, the end connector 20 further includes a fastener 30 fitted around the front portion of the inner sleeve 21 to locate in front of the outer sleeve 25. The fastener 30 has a rear end formed into a radially inward extended flange 31, which is externally fitted around a section of the inner sleeve 21 between the outward flange 23 of the inner sleeve 21 and the inward flange 27 of the outer sleeve 25. The fastener 30 is internally provided on a front inner wall surface with screw threads 32, and externally formed into a hexagonal head 33, at where a wrench or other hand tool may be used to lock the end connector 20 to an electronic device, such as a receiver or a terminal.

Figure 4:
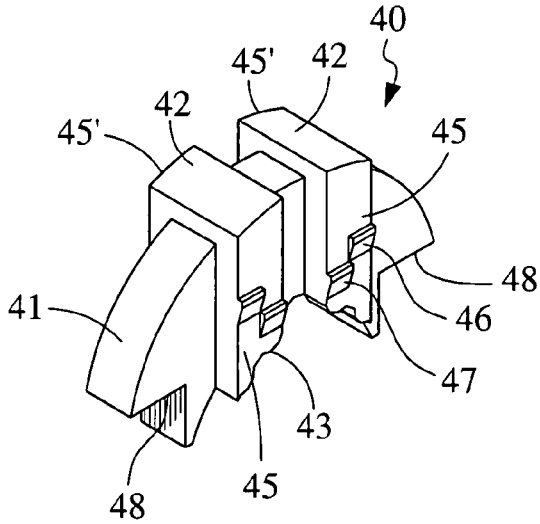
FIG. 4 is a perspective view of a sliding member included in the end connector of the present invention.

The end connector 20 of the present invention further includes a clamping structure, which includes at least one pair of sliding members 40 separately mounted in the transverse slots 28, 28' on the outer sleeve 25. Please refer to FIGS. 4 and 5, which are perspective and bottom views, respectively, of one sliding member 40 included in the present invention. As shown, each of the two sliding members 40 has a substantially arched body 41, on which at least one slide guide 42 is formed corresponding to the at least one guide slot 281, 281', so that the slide guide 42 on the sliding member 40 may vertically slide along the guide slot 281, 281'. In the illustrated embodiment, there are two slide guides 42 formed on each of the arched body 41.

Figure 5:
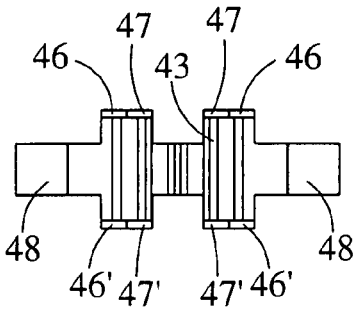
FIG. 5 is a bottom view of FIG. 4.

As can be seen from FIG. 5, the arched body 41 is provided on a bottom surface thereof with a plurality of teeth 43. Each of the slide guides 42 has a first surface 45 and a second surface 45' directed toward two opposite directions. The first and the second surface 45, 45' of the slide guide 42 are correspondingly provided at predetermined positions with an upper protrusion 46, 46' and a lower protrusion 47, 47' each. The upper protrusion 46, 46' and the lower protrusion 47, 47' on the same one surface 45, 45' are in staggered relation to each other.

The arched body 42 is formed at two lateral ends with a stopper 48 each. When the sliding members 40 have been fully slid into the transverse slots 28, 28', the stoppers 48 on the sliding members 40 are pressed against two lateral wall surfaces of the transverse slots 28, 28', preventing the sliding members 40 from moving any further toward a center of the outer sleeve 25.

Figure 6:
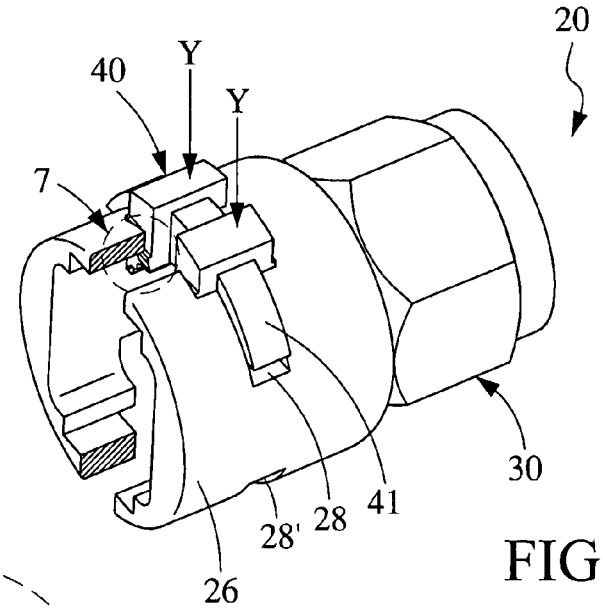
FIG. 6 is a perspective view of the coaxial cable end connector according to the present invention.
Figure 7:
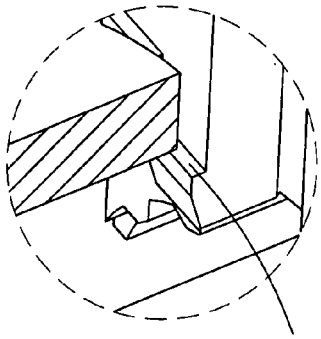
FIG. 7 is an enlarged view of the circled area in FIG. 6.
Figure 8:
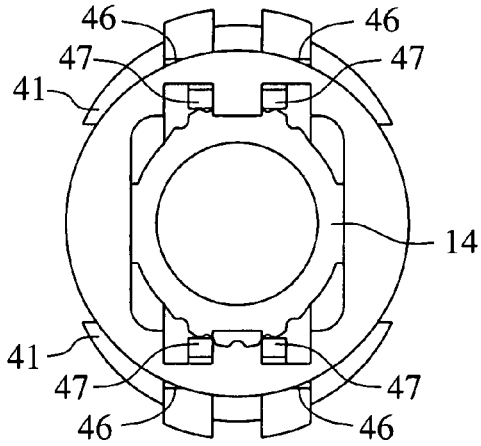
FIG. 8 is a right side view of FIG. 2.

FIG. 6 is a perspective view showing the coaxial cable end connector 20 with one sliding member 40 mounted in the transverse slot 28. When the sliding member 40 is subjected to a force perpendicularly applied thereto as indicated by the arrows Y in FIG. 6, the sliding member 40 is moved toward the center of the outer sleeve 25, so that the lower protrusions 47, 47' are abutted at respective tops on a bottom of the transverse slot 28, as shown in FIGS. 7 and 8, bringing the sliding member 40 to temporarily associated with and held to the main body 26 of the outer sleeve 25. In this manner, the sliding members 40 are prevented from separating from the outer sleeve 25.

Figure 9:
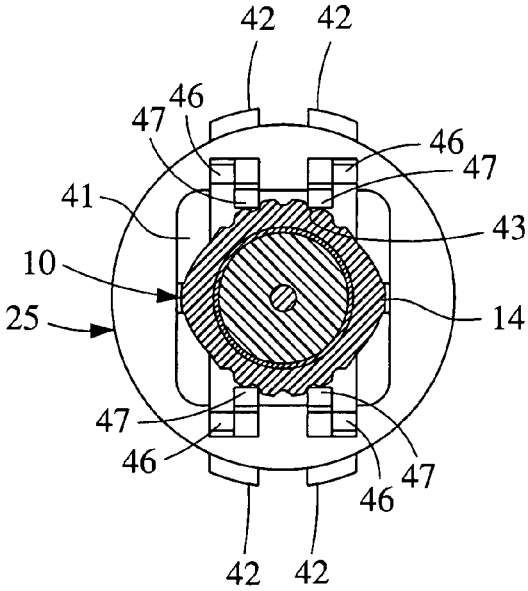
FIG. 9 is a cross sectional view taken on line 9-9 of FIG. 1.

With the sliding members 40 mounted in the transverse slots 28, 28' on the outer sleeve 25, the coaxial cable 10 may be inserted into the end connector 20 via a rear open end of the main body 26 of the outer sleeve 25. At this point, the sliding members 40 may be further moved toward the center of the outer sleeve 25 by perpendicularly applying a force on the sliding members 40, so that the upper protrusions 46, 46' are abutted at respective tops on the bottom of the transverse slots 28, 28', as shown in FIG. 9, which is a cross sectional view taken on line 9-9 of FIG. 1. At this point, the teeth 43 at the bottom surfaces of the arched bodies 41 are forced to firmly contact with an outer surface of the jacket 14 of the coaxial cable 10.

The sliding members 40 are mounted on the outer sleeve 25 in the transverse slots 28, 28' before the coaxial cable 10 is connected at an end to the end connector 20. When the coaxial cable 10 has been pushed into the end connector 20, the exposed central conductor 11 and insulator 12 are extended into the main body 22 of the inner sleeve 21, and the braided conducting sheath 13 and the jacket 14 are extended into the annular space between the extension section 24 behind the main body 22 of the inner sleeve 21 and the main body 26 of the outer sleeve 25. When the coaxial cable 10 has been fully inserted into the end connector 20, a free end of the jacket 14 covered by the turned-back braided conducting sheath 13 is brought to tightly bear against the inward flange 27 at the front end of the main body 26 of the outer sleeve 25, and the central conductor 11 is extended into the fastener 30 to forward project from a front opening of the fastener 30 by a predetermined distance. At this point, a clamping tool is used to apply two opposite radial forces on the two sliding members 40 for them to move toward the center of the outer sleeve 25 and thereby force the teeth 43 at the bottom surfaces of the sliding members 40 to tightly press against and connect to the jacket 14 of the coaxial cable 10.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A coaxial cable end connector for electrically and mechanically connecting a coaxial cable to an electronic device, the coaxial cable having a central conductor, an insulator surrounding the central conductor, at least one layer of braided conducting sheath surrounding the insulator, and a jacket surrounding the braided conducting sheath; the end connector comprising:

a hollow inner sleeve adapted to receive the central conductor and the insulator of the coaxial cable therein;

a hollow outer sleeve coaxial with the inner sleeve to define an annular space between the outer and the inner sleeve for receiving the braided conducting sheath and the jacket of the coaxial cable therein;

the outer sleeve including a main body, on which at least two diametrically opposite transverse slots are provided;

a clamping structure mounted in the transverse slots on the main body of the outer sleeve, such that the clamping structure may be moved toward a center of the outer sleeve and accordingly the jacket of the coaxial cable in a direction perpendicular to the coaxial cable; and a plurality of teeth formed at a bottom surface of the clamping structure for tightly pressing against and connecting to the jacket of the coaxial cable when the coaxial cable has been fully inserted into the inner and the outer sleeve and the clamping structure is moved to the center of the outer sleeve.

2. The coaxial cable end connector as claimed in claim 1, wherein the clamping structure includes at least one pair of sliding members separately movably mounted in the at least two transverse slots; each of the sliding members including at least one slide guide corresponding to at least one guide slot formed on each of the transverse slots on the main body of the outer sleeve, so that the sliding member is allowed to move in the transverse slot in a direction perpendicular to the outer sleeve.

3. The coaxial cable end connector as claimed in claim 2, wherein the at least one slide guide has a first surface, on which an upper and a lower protrusion are arranged in a staggered relation to each other;

whereby when the slide guide is moved toward the center of the outer sleeve and the lower protrusion is brought to abut at a top on a bottom of the transverse slot, the sliding member is temporarily associated with and held to the main body of the outer sleeve; and when the coaxial cable has been fully inserted into the inner and the outer sleeve, and the slide guide is further moved toward the center of the outer sleeve until the upper protrusion is abutted at a top on the bottom of the transverse slot, the sliding member is tightly pressed against the jacket of the coaxial cable.

4. The coaxial cable end connector as claimed in claim 3, wherein the at least one slide guide has a second surface opposite to the first surface, and the second surface being provided with an upper and a lower protrusion corresponding to the upper and lower protrusions on the first surface, respectively.

5. The coaxial cable end connector as claimed in claim 2, wherein each of the sliding members has two lateral ends formed into a stopper each; and the stoppers being pressed against two lateral wall surfaces of the transverse slot when the sliding member is fully moved into the transverse slot, so that the sliding member is prevented from moving any further toward the center of the outer sleeve.

* * * * *